US009412495B1

(12) United States Patent
Bennett et al.

(10) Patent No.: US 9,412,495 B1
(45) Date of Patent: Aug. 9, 2016

(54) WIRE AND CABLE HAVING INTEGRALLY FORMED JACKET AND PARTITIONED WALL MEMBERS AND PROCESS AND APPARATUS FOR MAKING THE SAME

(75) Inventors: Mark D. Bennett, Ravenna, TX (US); William Thomas Bigbee, Jr., Melissa, TX (US); Steve Griffin, McKinney, TX (US)

(73) Assignee: Encore Wire Corporation, McKinney, TX (US)

( * ) Notice: Subject to any disclaimer, the term of this patent is extended or adjusted under 35 U.S.C. 154(b) by 1253 days.

(21) Appl. No.: 13/269,004

(22) Filed: Oct. 7, 2011

(51) Int. Cl.
*H01B 7/00* (2006.01)
*H01B 7/18* (2006.01)
*H01B 17/58* (2006.01)

(52) U.S. Cl.
CPC ..... *H01B 7/185* (2013.01); *H01B 17/58* (2013.01)

(58) Field of Classification Search
CPC ..... H01B 7/185; H01B 17/58
USPC ..... 174/115, 113 R
See application file for complete search history.

(56) References Cited

U.S. PATENT DOCUMENTS

| | | | | |
|---|---|---|---|---|
| 919,384 | A * | 4/1909 | Runzel | H01B 7/0823 174/116 |
| 1,984,038 | A | 12/1934 | Shaw et al. | |
| 2,081,634 | A | 5/1937 | McNamee | |
| 2,105,812 | A | 1/1938 | Gordon et al. | |
| 2,149,002 | A | 2/1939 | Wermine | |
| 2,204,782 | A | 6/1940 | Wermine | |
| 2,455,773 | A | 12/1948 | Johnson | |
| 2,628,998 | A | 2/1953 | Frisbie | |
| 2,659,932 | A | 11/1953 | McNamee | |
| 2,805,276 | A | 9/1957 | Weitzel | |
| D185,855 | S | 8/1959 | Scofield | |
| 3,448,204 | A | 6/1969 | Perrone et al. | |
| 3,564,108 | A | 2/1971 | Schmitz | |
| 3,703,421 | A | 11/1972 | Fisher | |
| 4,221,756 | A | 9/1980 | Piper et al. | |
| 4,472,598 | A | 9/1984 | Boyd et al. | |
| 4,487,997 | A * | 12/1984 | Ditchfield | H01B 7/38 174/115 |
| 5,587,115 | A | 12/1996 | Allen | |
| 5,679,157 | A | 10/1997 | Milliman | |
| 6,248,954 | B1 * | 6/2001 | Clark et al. | 174/113 R |
| 6,847,767 | B2 | 1/2005 | Hurley et al. | |
| 2006/0160402 | A1 * | 7/2006 | Kowalski | H01B 11/02 439/397 |

* cited by examiner

*Primary Examiner* — Hoa C Nguyen
*Assistant Examiner* — Amol Patel
(74) *Attorney, Agent, or Firm* — Warren Rhoades LLP

(57) ABSTRACT

An electrical cable having an integrally formed jacket and partitioned wall members and process and apparatus for making the same, wherein the electrical cable comprises a non-metallic jacket that encapsulates an insulated conductor and a bare grounding conductor, wherein the insulated conductor and the bare grounding material are separated by a wall that runs the length of the electrical cable and is integrally formed with the jacket. A die assembly unit for manufacturing an electrical cable having an integrally formed jacket and partitioned wall members. The die assembly unit comprising a die assembly nozzle and a die assembly cap. The die assembly nozzle further comprising an extrusion tip with at least one wall channel to allow for the creation of the integrally formed wall members.

24 Claims, 2 Drawing Sheets

WIRE AND CABLE HAVING INTEGRALLY FORMED JACKET AND PARTITIONED WALL MEMBERS AND PROCESS AND APPARATUS FOR MAKING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

This invention relates to electrical cables, and particularly non-metallic electrical cables with integrally formed jacket and partitioned wall members.

2. Description of Related Art

NM-B cable is a common form of indoor residential electrical wire. Traditional NM-B cable consists of two or more PVC insulated conductors and a bare grounding conductor. The bare grounding conductor is individually wrapped in a paper sheath. Additionally, all of the insulated conductors and the bare ground wire may be wrapped in a paper sheath that encompasses the entire wire construction. A PVC jacket is the outermost layer of the construction and encapsulates all of the wires and paper. This construction has been used for a number of years.

Traditional NM-B cable presents several shortcomings. First, traditional NM-B is inconvenient for installation due to the need to remove the paper surrounding the bare grounding conductor. Second, traditional NM-B uses a significant amount of paper, thereby increasing the cost of the wire and depleting natural resources. Third, the inclusion of paper in making traditional NM-B cable slows down the production rate. Fourth, during production the paper may tear, resulting in halting the production process and scrap wire. Thus, there is a need for an NM-B cable that can overcome these shortcomings by eliminating the need for a paper.

BRIEF SUMMARY OF THE INVENTION

The present disclosure is directed to a non-metallic cable having an integrally formed jacket and partitioned wall members and method and apparatus for making the same. In one embodiment, an electrical cable comprises a non-metallic jacket that encapsulates an insulated conductor and a bare grounding conductor, wherein the insulated conductor and the bare grounding material are separated by a wall that runs the length of the electrical cable and is integrally formed with the jacket. In another embodiment, a die assembly unit is used to form a non-metallic cable having an integrally formed jacket and partitioned wall members, wherein the die assembly unit comprises a die assembly nozzle comprising an extrusion tip having an at least one wall channel and a curved angled surface, operating in conjunction with a die assembly cap.

In another embodiment the manufacturing of the electrical cable is accomplished by a method comprising providing a material, extruding the material into a die assembly unit, feeding a bare grounding conductor through an extrusion tip having an at least one wall channel, feeding an insulated conductor and a bare grounding conductor through the extrusion tip, engaging the material with the extrusion tip, whereby the material conforms to the extrusion tip and the at least one wall channel, whereby the material encapsulates the bare grounding conductor and insulated conductor, thereby forming a finished electrical cable having an integrally formed jacket and at least one partitioned wall.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

In the drawings.

DETAILED DESCRIPTION OF THE INVENTION

Figure 1:
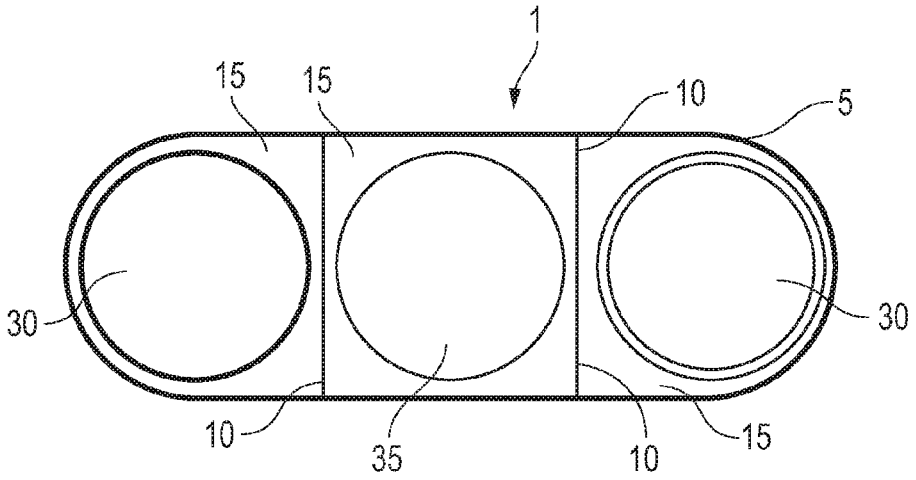
FIG. 1 illustrates an end view of an embodiment of an electrical cable having an integrally formed jacket and partitioned walls.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It should be understood that any one of the features of the invention may be used separately or in combination with other features. Other systems, methods, features, and advantages of the present invention will be or become apparent to one with skill in the art upon examination of the drawings and the detailed description. It is intended that all such additional systems, methods, features, and advantages be included within this description, be within the scope of the present invention, and be protected by the accompanying claims.

The present disclosure is described below with reference to the Figures in which various embodiments of the present invention are shown. The subject matter of the disclosure may, however, be embodied in many different forms and should not be construed as limited to the exemplary embodiments set forth herein.

FIG. 1 shows an end view of an embodiment of an electrical cable having an integrally formed jacket and walls. As shown in FIG. 1, the electrical cable 1 comprises a jacket 5, the jacket 5 is comprised of a non-metallic material such as PVC. One skilled in the art will readily recognize that other compounds are contemplated for use in the cable 1. The cable 1 further comprises one or more insulated conductors 30 and one or more bare grounding conductors 35. The one or more insulated conductors 30 and the one or more bare grounding conductors 35 are separated by an integrally formed wall 10. The integrally formed wall 10 extends from one portion of the jacket 5 to another portion of the jacket 5 and runs the length of the electrical cable 1, thereby forming chambers within the electrical cable 1. The integrally formed wall 10 is comprised of the same material as the jacket 5. In one embodiment, the integrally formed wall 10 is formed in such a manner that a free space 15 exists between the insulated conductor 30, the jacket 5, and the integrally formed wall 10.

In another embodiment, the integrally formed wall 10 is formed in such a manner that a free space 15 exists between the bare grounding conductor 35, the jacket 5, and the integrally formed wall 10. As shown in FIG. 1, the cable 1 comprises three chambers, two insulated conductors 30, and a bare grounding conductor 35, wherein the first insulated conductor 30 is located in a first chamber, the bare grounding conductor 35 is located in a second chamber, and the second insulated conductor 35 is located in a third chamber. One skilled in the art will readily recognize that other constructions are contemplated for use in the cable 1. For example, in another embodiment, the cable 1 comprises two chambers, a plurality of insulated conductors 30, and a bare grounding conductor 35, wherein the plurality of insulated conductors 30 are located in the first chamber and the bare grounding conductor 35 is located in the second chamber.

Figure 2:
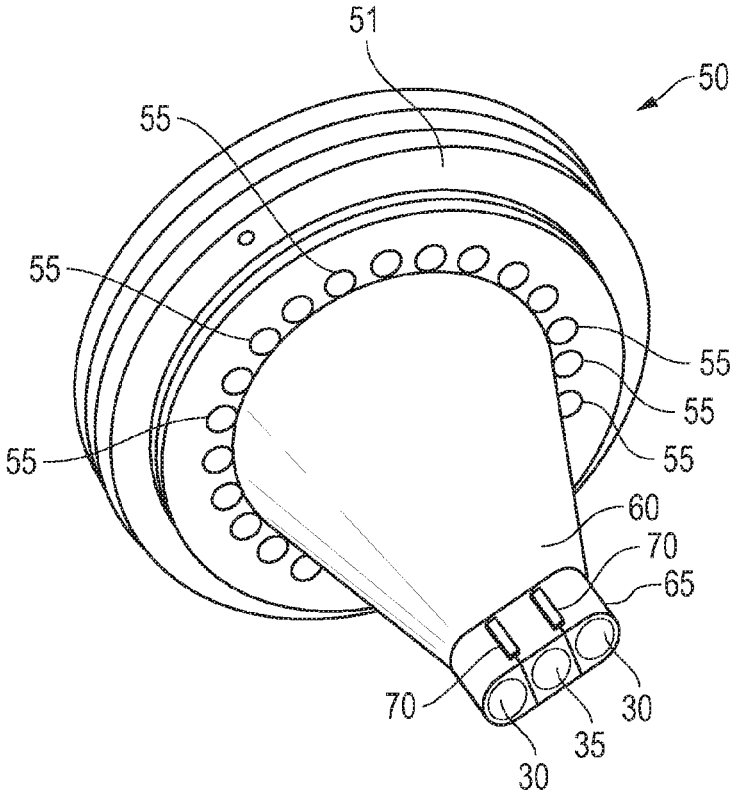
FIG. 2 illustrates an embodiment of a die assembly nozzle for manufacturing an electrical cable having an integrally formed jacket and partitioned walls.

FIG. 2 shows an embodiment of a die assembly nozzle 50 for manufacturing an electrical cable having an integrally formed jacket and partitioned walls. As shown in FIG. 2, the die assembly nozzle 50 comprises a base 51. The die assembly nozzle 50 further comprises one or more extrusion holes 55. One skilled in the art will recognize that the extrusion holes 55 may be located in various locations and in varying quantities. For instance, the extrusion holes 55 may be located on a curved angled surface 60. In one embodiment, the extruded non-metallic material proceeds along the curved angled surface 60 until it arrives at an extrusion tip 65. The extrusion tip 65 is shaped in substantially the same manner as the cable 1. Passing through the extrusion tip 65 are one or more wall channels 70. The one or more wall channels 70 function to create the one or more integrally formed walls 10 in the cable 1 during the extrusion process. During the manufacture of the cable 1, the one or more insulated conductors 30 and the one or more bare grounding conductors 35 are fed through the extrusion tip 65 and separated by the wall channels 70. In one embodiment, the one or more wall channels 70 are formed and positioned such that the free space 15 exists between the insulated conductor 30, the extrusion tip 65, and the wall channel 70. In another embodiment, the one or more wall channels 70 are located such that the free space 15 exists between the bare grounding conductor 35 and the wall channels 70.

Figure 3:
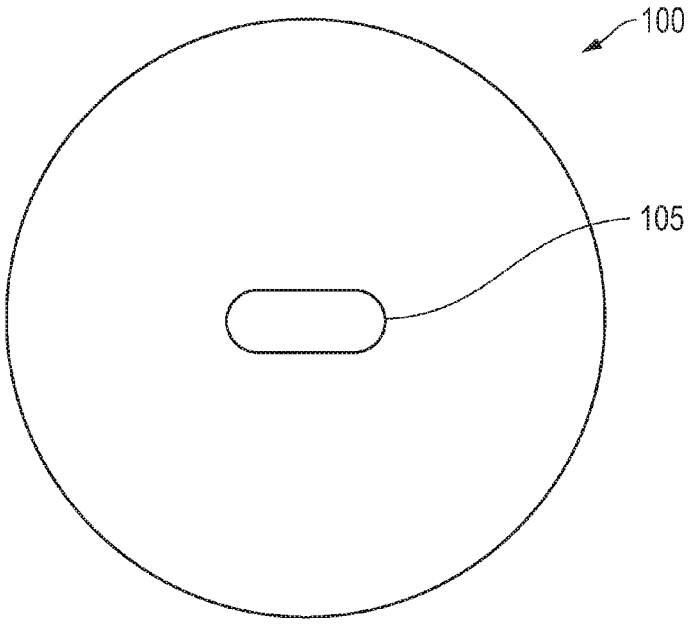
FIG. 3 illustrates an embodiment of a die assembly cap for manufacturing an electrical cable having an integrally formed jacket and partitioned walls.

FIG. 3 shows an embodiment of a die assembly cap 100. In one embodiment, the die assembly cap 100 connects to the die assembly nozzle 50 at the base 51 (shown in FIG. 2). As shown in FIG. 3, the die assembly cap 100 comprises an opening 105. The shape of the opening 105 corresponds to the shape of the cable 1. In one embodiment, the die assembly cap 100 may have extrusion holes 55, such that the non-metallic material, such as PVC, which will ultimately form the jacket 5 and integrally formed walls 10 can pass through the die assembly cap 100 and engage the curved angled surface 60 (shown in FIG. 2). In one embodiment, the interior of the die assembly cap 100 is designed to mirror, and thus fit, the curved angled surface 60 thereby forming a funnel leading to the extrusion tip 65.

Figure 4:
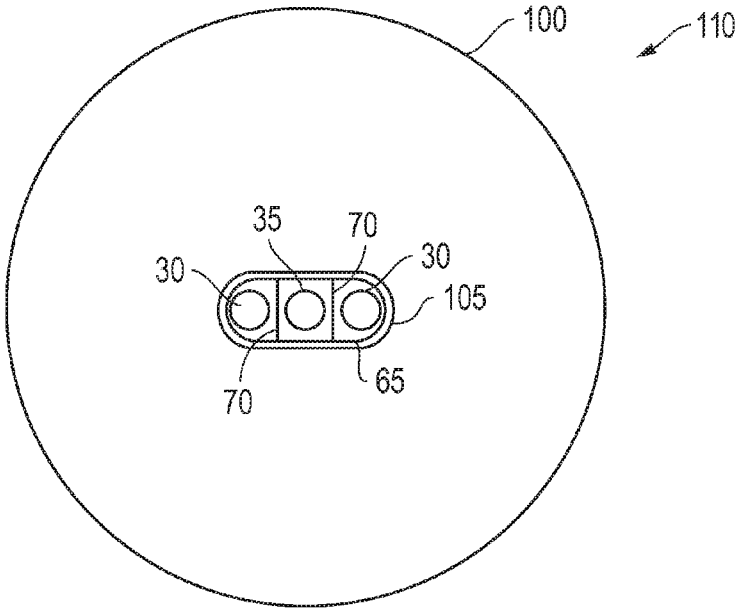
FIG. 4 illustrates an embodiment of a die assembly unit formed by combining the die assembly nozzle from FIG. 2 with the die assembly cap from FIG. 3.

FIG. 4 shows an embodiment of a die assembly unit 110. The die assembly unit 110 comprises the die assembly cap 100 fitted over the die assembly nozzle 50. The extrusion tip 65 fits within the opening 105. A non-metallic material, such as PVC, which will ultimately form the jacket 5 and the integrally formed walls 10 is heated and extruded through the extrusion holes 55. One skilled in the art will readily recognize that other non-metallic compounds are contemplated for use with the die assembly nozzle 50. The extruded material proceeds along the funnel formed by the curved angled surface 60 and the interior of the die assembly cap 100 towards the extrusion tip 65. At the extrusion tip 65 some of the extruded material passes through the wall channels 70 and some of the extruded material encases the extrusion tip 65. As a result, the extruded material forms the jacket 5 and the integrally formed walls 10 such that the jacket 5 and the integrally formed walls 10 encapsulate the one or more insulated conductors 30 and the one or more bare grounding conductors 35.

Different embodiments may be formed in a similar manner having different characteristics depending upon need, performance, or some other criteria. It will be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

What is claimed is:

1. An NM-B electrical cable, the cable comprising:

a bare grounding conductor;

an insulated conductor;

a jacket comprised of a material, wherein the jacket encapsulates the bare grounding conductor and the insulated conductor; and a wall integrally formed with the jacket, wherein the wall separates the bare grounding conductor and the insulated conductor, the wall extends from one portion of the jacket to another portion of the jacket and extends the entire length of the NM-B electrical cable, and wherein the jacket and wall are comprised of the same material and a free space exists between the bare grounding conductor and the wall.

2. The electrical cable of claim 1, wherein the jacket is non-metallic.

3. The electrical cable of claim 1, wherein a free space exists between the insulated conductor and the wall.

4. The electrical cable of claim 1, wherein the wall forms a first and second chamber inside the jacket.

5. The electrical cable of claim 4, wherein the insulated conductor and the bare grounding conductor are located in different chambers.

6. The electrical cable of claim 4, further comprising:

a second insulated conductor.

7. The electrical cable of claim 6, wherein the second insulated conductor is located in the same chamber as the insulated conductor.

8. The electrical cable of claim 6, further comprising:

a second wall, wherein the second wall forms a third chamber inside the jacket; and wherein the insulated conductor is located in the first chamber, the bare grounding conductor is located in the second chamber, and the second insulated conductor is located in the third chamber.

9. An NM-B electrical cable, the cable comprising:

a bare grounding conductor;

an insulated conductor;

a jacket comprised of a material, wherein the jacket encapsulates the bare grounding conductor and the insulated conductor;

a wall integrally formed with the jacket;

wherein the wall separates the bare grounding conductor and the insulated conductor, the wall extends from one portion of the jacket to another portion of the jacket and extends the entire length of the NM-B electrical cable, and wherein the jacket and wall are comprised of the same material and wherein a free space exists between the insulated conductor and the wall.

10. The electrical cable of claim 9, wherein the jacket is non-metallic.

11. The electrical cable of claim 9, wherein a free space exists between the bare grounding conductor and the wall.

12. The electrical cable of claim 9, wherein the wall forms a first and second chamber inside the jacket.

13. The electrical cable of claim 12, wherein the insulated conductor and the bare grounding conductor are located in different chambers.

14. The electrical cable of claim 12, further comprising:

a second insulated conductor.

15. The electrical cable of claim 14, wherein the second insulated conductor is located in the same chamber as the insulated conductor.

16. The electrical cable of claim 14, further comprising:

a second wall, wherein the second wall forms a third chamber inside the jacket; and wherein the insulated conductor is located in the first chamber, the bare grounding conductor is located in the second chamber, and the second insulated conductor is located in the third chamber.

17. An NM-B electrical cable, the cable comprising:

a jacket comprised of a material;

a bare grounding conductor encapsulated by the jacket;

a first insulated conductor encapsulated by the jacket;

a second insulated conductor encapsulated by the jacket;

a first wall integrally formed with the jacket, wherein the first wall separates the bare grounding conductor and the first insulated conductor, wherein the first wall extends from one portion of the jacket to another portion of the jacket and extends the entire length of the NM-B electrical cable, wherein the jacket and first wall are comprised of the same material, and wherein the first wall forms a first and second chamber inside the jacket;

a second wall integrally formed with the jacket, wherein the second wall forms a third chamber inside the jacket; and wherein the first insulated conductor is located in the first chamber, the bare grounding conductor is located in the second chamber, and the second insulated conductor is located in the third chamber.

18. The electrical cable of claim 17, wherein the jacket is non-metallic.

19. The electrical cable of claim 17, wherein a free space exists between the bare grounding conductor and the first wall.

20. The electrical cable of claim 19, wherein a free space exists between the bare grounding conductor and the second wall.

21. The electrical cable of claim 17, wherein a free space exists between the first insulated conductor and the first wall.

22. The electrical cable of claim 21, wherein a free space exists between the first conductor and the second wall.

23. The electrical cable of claim 17, wherein a free space exists between the second insulated conductor and the first wall.

24. The electrical cable of claim 23, wherein a free space exists between the second conductor and the second wall.

* * * * *